US008616848B2

(12) United States Patent
Beeck

(10) Patent No.: US 8,616,848 B2
(45) Date of Patent: Dec. 31, 2013

(54) TURBINE BLADE DAMPING DEVICE WITH CONTROLLED LOADING

(75) Inventor: Alexander R. Beeck, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 926 days.

(21) Appl. No.: 12/637,066

(22) Filed: Dec. 14, 2009

(65) Prior Publication Data

US 2011/0142650 A1 Jun. 16, 2011

(51) Int. Cl.
*F01D 5/16* (2006.01)

(52) U.S. Cl.
USPC ..... 416/189; 416/193 R; 416/500

(58) Field of Classification Search
USPC ..... 416/179, 189, 190, 191, 193 R, 194, 416/196 R, 500
See application file for complete search history.

(56) References Cited

U.S. PATENT DOCUMENTS

| | | | | |
|---|---|---|---|---|
| 2,772,854 | A * | 12/1956 | Anxionnaz | 416/190 |
| 2,914,299 | A | 11/1959 | Mitchell | |
| 3,055,634 | A | 9/1962 | Mitchell | |
| 3,209,838 | A | 10/1965 | Frankel | |
| 3,216,699 | A | 11/1965 | Schoenborn | |
| 3,451,654 | A | 6/1969 | Johnson | |
| 3,708,244 | A | 1/1973 | Dawson et al. | |
| 3,771,922 | A | 11/1973 | Tracy | |
| 4,083,655 | A | 4/1978 | Tempere | |
| 4,257,743 | A * | 3/1981 | Fujii | 416/196 R |
| 4,734,010 | A | 3/1988 | Battig | |
| 5,695,323 | A | 12/1997 | Pfeifer et al. | |

FOREIGN PATENT DOCUMENTS

| | | |
|---|---|---|
| EP | 0203287 A1 | 12/1986 |
| FR | 1034375 A | 7/1953 |
| FR | 1252763 A | 5/1961 |
| GB | 1234566 | 6/1971 |
| JP | 49120901 U | 10/1974 |

* cited by examiner

*Primary Examiner* — Edward Look
*Assistant Examiner* — Jason Davis

(57) ABSTRACT

A damping structure for a turbomachine rotor. The damping structure includes an elongated snubber element including a first snubber end rigidly attached to a first blade and extending toward an adjacent second blade, and an opposite second snubber end defining a first engagement surface positioned adjacent to a second engagement surface associated with the second blade. The snubber element has a centerline extending radially inwardly in a direction from the first blade toward the second blade along at least a portion of the snubber element between the first and second snubber ends. Rotational movement of the rotor effects relative movement between the first engagement surface and the second engagement surface to position the first engagement surface in frictional engagement with the second engagement surface with a predetermined damping force determined by a centrifugal force on the snubber element.

16 Claims, 2 Drawing Sheets

TURBINE BLADE DAMPING DEVICE WITH CONTROLLED LOADING

CROSS-REFERENCE TO RELATED APPLICATION

This application is related to and filed on even date with an application having U.S. application Ser. No. 12/637,106 entitled, "TURBINE BLADE DAMPING DEVICE WITH CONTROLLED LOADING", which is incorporated herein by reference in its entirety.

FIELD OF THE INVENTION

The present invention relates generally to vibration damping of turbine blades in a turbomachine and, more particularly, to a damping structure comprising a snubber providing a controlled damping force.

BACKGROUND OF THE INVENTION

A turbomachine, such as a steam or gas turbine is driven by a hot working gas flowing between rotor blades arranged along the circumference of a rotor so as to form an annular blade arrangement, and energy is transmitted from the hot working gas to a rotor shaft through the rotor blades. As the capacity of electric power plants increases, the volume of flow through industrial turbine engines has increased more and more and the operating conditions (e.g., operating temperature and pressure) have become increasingly severe. Further, the rotor blades have increased in size to harness more of the energy in the working gas to improve efficiency. A result of all the above is an increased level of stresses (such as thermal, vibratory, bending, centrifugal, contact and torsional) to which the rotor blades are subjected.

In order to limit vibrational stresses in the blades, various structures may be provided to the blades to form a cooperating structure between blades that serves to dampen the vibrations generated during rotation of the rotor. For example, mid-span snubbers, such as cylindrical standoffs, may be provided extending from mid-span locations on the blades for engagement with each other. Two mid-span snubbers are located at the same height on either side of a blade with their respective contact surfaces pointing opposite directions. The snubber contact surfaces on adjacent blades are separated by a small gap when the blades are stationary. However, when the blades rotate at full load and untwist under the effect of the centrifugal forces, snubber surfaces on adjacent blades come in contact with each other. In addition, each turbine blade may be provided with an outer shroud located at an outer edge of the blade and having front and rear shroud contact surfaces that move into contact with each other as the rotor begins to rotate. The engagement between the blades at the front and rear shroud contact surfaces and at the snubber contact surfaces is designed to improve the strength of the blades under the tremendous centrifugal forces, and further operates to dampen vibrations by friction at the contacting snubber surfaces. A disadvantage of snubber damping is that on large diameter blades it is often difficult to achieve the desired contact forces produced between snubbers as a result of the centrifugal untwisting of the blades. In addition, the large mechanical load associated with large diameter blades typically necessitates larger snubber structures for mechanical stability to avoid outward bending of the snubber, resulting in increased aerodynamic losses and flow inefficiencies due to the flow restriction of larger snubbers positioned in the high velocity flow area through the part-span area.

SUMMARY OF THE INVENTION

In accordance with an aspect of the invention, a damping structure in a turbomachine rotor is provided, the turbomachine comprising a rotor disk and a plurality of blades. The damping structure comprises an elongated snubber element including a first snubber end rigidly attached to a first blade and extending toward an adjacent second blade, and an opposite second snubber end defining a first engagement surface positioned adjacent to a second engagement surface associated with the second blade. The snubber element has a centerline extending radially inwardly in a direction from the first blade toward the second blade along at least a portion of the snubber element between the first and second snubber ends. Rotational movement of the rotor effects relative movement between the second snubber end and the second engagement surface to position the first engagement surface of the second snubber end in frictional engagement with the second engagement surface with a predetermined damping force determined by a centrifugal force on the snubber element.

The damping structure may be located at a mid-span location between a blade root and a blade tip of the blade.

The cooperating surface may be at least partly formed on a side surface of the second blade.

The centerline of the snubber element may comprise a substantially smooth curve with a concave side facing radially outwardly extending from the first snubber end to the second snubber end.

The centerline of the snubber element may comprise first and second linear centerline segments and an inflexion angle between the centerline segments at a midway point between the first and second blades, the first centerline segment angling radially inwardly from the first snubber end to the midway point and the second centerline segment angling radially outwardly from the midway point to the second snubber end.

The snubber element may comprise a first snubber element and the damping structure may further comprise a second snubber element having a first snubber end rigidly attached to the second blade and a second snubber end located adjacent to the second end of the first snubber element, the second snubber end of the second snubber element defining the cooperating surface. In addition, a snubber gap may be defined between the first and second snubber elements when the rotor is stationary, and the first and second snubber elements may define respective first and second centerline segments that angle radially inwardly from the first snubber end toward the snubber gap, and the second ends of the first and second snubber elements move radially outwardly to engage each other with a predetermined force during rotation of the rotor.

A midway point is defined between the first and second blades and a radial thickness of the snubber element may decrease extending from each of the blades to the midway point.

In accordance with another aspect of the invention, a mid-span damping structure in a turbomachine rotor is provided, the turbomachine comprising a rotor disk and a plurality of blades. The mid-span damping structure comprises an elongated first snubber element including a first snubber end rigidly attached to a first blade, and an opposite second snubber end, the first snubber element extending toward an adjacent second blade. An elongated second snubber element including a first snubber end rigidly attached to the second blade, and an opposite second snubber end, the second snubber element extending toward the first blade. The second end of the first snubber element is located adjacent to the second end of the second snubber element at a midway point between the first and second blades. The first and second snubber elements define a centerline extending radially inwardly in a direction from the first blade toward the midway point and extending radially inwardly in a direction from the second blade toward the midway point. Rotational movement of the rotor effects relative movement between the second snubber ends of the first and second snubber elements to position the second snubber ends in frictional engagement with each other with a predetermined damping force determined by a centrifugal force on the first and second snubber elements.

The centerline defined by the first and second snubber elements may comprise first and second linear centerline segments wherein the first and second centerline segments each extend radially inwardly from a circumferential line extending between the first snubber ends of the first and second snubber elements at an angle of about 6° to define an inflexion angle of about 178°.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
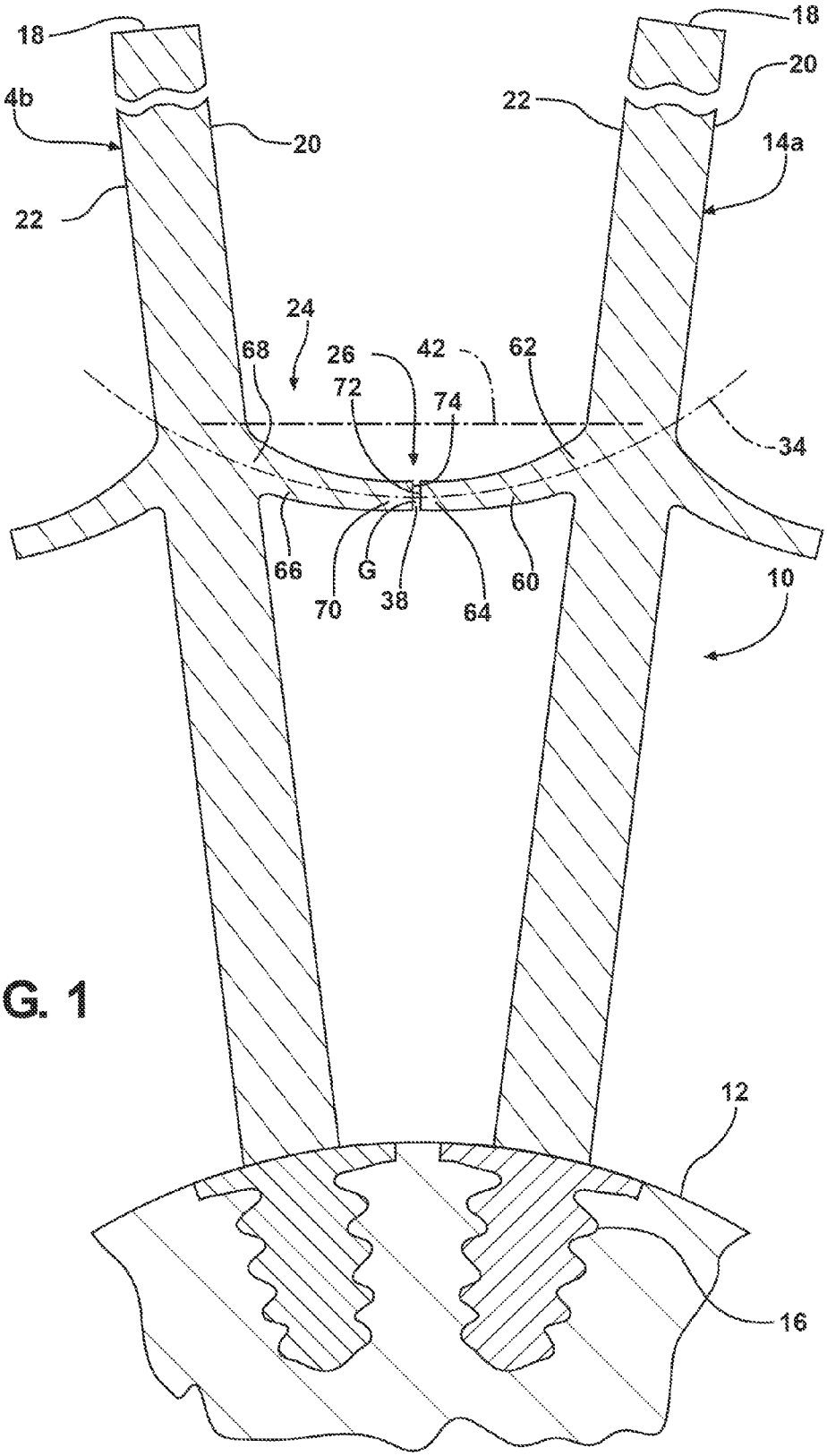
FIG. 1 is a partial end view of a rotor, as viewed in an axial flow direction, taken in a plane perpendicular to an axis of rotation and showing an embodiment of the invention.

Referring to FIG. 1, a section of a rotor 10 is illustrated for use in a turbomachine (not shown), such as for use in a gas or steam turbine. The rotor 10 comprises a rotor disk 12 and a plurality of blades 14, illustrated herein as a first blade 14*a* and an adjacent second blade 14*b*. The blades 14 comprise radially elongated structures extending from a blade root 16, engaged with the rotor disk 12, to a blade tip 18. Each of the blades 14*a*, 14*b* includes a pressure side surface 20 and a suction side surface 22. The rotor 10 further includes a damping structure 24 extending between the first and second blades 14*a*, 14*b*, and located mid-span between the blade root 16 and the blade tip 18 of the blades 14*a*, 14*b*.

The damping structure 24 includes an elongated snubber structure 26 comprising an elongated first snubber element 60 extending from the first blade 14*a* toward the adjacent second blade 14*b*. The first snubber element 60 includes a first snubber end 62 rigidly attached to the first blade 14*a*, and an opposite second snubber end 64 extending to a midway point 38. An elongated second snubber element 66 extends from the second blade 14*b* toward the first blade 14*a* and includes a first snubber end 68 rigidly attached to the second blade 14*b*, and an opposite second snubber end 70 extending to the midway point 38.

The second snubber end 64 of the first snubber element 60 defines a first engagement surface 72 located adjacent to a second engagement surface 74 on the second snubber end 70 of the second snubber element 66 at the midway point 38 between the first and second blades 14*a*, 14*b*. A snubber gap G is defined between the adjacent engagement surfaces 72, 74 when the rotor 10 is stationary, i.e., with no centrifugal forces acting on the first and second snubber elements 60, 66.

The first and second snubber elements 60, 66 define a centerline 34 extending radially inwardly in a direction from the first blade 14*a* toward the midway point 38 and extending radially inwardly in a direction from the second blade 14*b* toward the midway point 38. The centerline 34 defined by the first and second snubber elements 60, 66 comprises a substantially smooth curve with a concave side facing radially outwardly toward a circumferential line 42 extending between radially outer edges of the first snubber end 62 of the first snubber element 60 and the first snubber end 68 of the second snubber element 66.

Rotational movement of the rotor 10 effects relative movement between the second snubber ends 64, 70 of the first and second snubber elements 60, 66 to close the snubber gap G and position the first engagement surface 72 in frictional engagement with the second engagement surface 74 with a predetermined damping force determined by a centrifugal force acting on the first and second snubber elements 60, 66. In particular, the centrifugal force acting on the first and second snubber elements 60, 66 effects a movement of the snubber elements 60, 66 radially outwardly, causing them to pivot toward each other and the snubber gap G to be closed. In addition, it should be noted that the second ends 64, 70 of the snubber elements 60, 66 are located to define the snubber gap G at a location between the blades 14*a*, 14*b* where the second ends 64, 70 will remain at substantially the same position relative to each other during rotor spin-up and corresponding blade untwist, i.e., with pivoting movement of the snubber elements 60, 66 in a plane generally parallel to the axial and circumferential directions during blade untwist. Hence, the first engagement surface 72 will remain in facing relation to the second engagement surface 74 regardless of blade untwist during rotor spin-up and will be positioned in locking frictional engagement during operation of the turbine.

It should be noted that it is desirable to configure the snubber structure 26 to produce a damping force that is sufficient to produce damping at the interface between the first and second engagement surfaces 72, 74 to control blade vibration without substantially exceeding this minimum damping force. An excess force at this location may lead to excessive wear and stress on the first and second engagement surfaces.

The inward angle formed by the curvature of the first and second snubber elements 60, 66, as defined by the centerline 34, substantially alters the damping force produced by centrifugal force on the first and second snubber elements 60, 66. The centrifugal force exerted on the first and second snubber elements 60, 66 causes the snubber elements 60, 66 to bend outwardly and become less concave, producing the damping force between the blades 14. A larger centerline curvature will produce a greater centrifugal load on the snubber elements 60, 66 and a greater damping force applied between the first and second engagement surfaces 72, 76. For example, the centerline 34 may correspond to the shape of a hanging chain. It is believed that a snubber structure 26 configured with a centerline 34 having a relatively shallow curve may be sufficient to produce an adequate centrifugal force on the snubber structure 26 and provide the necessary damping force to reduce blade vibration while effectively controlling the level of force applied.

Figure 2:
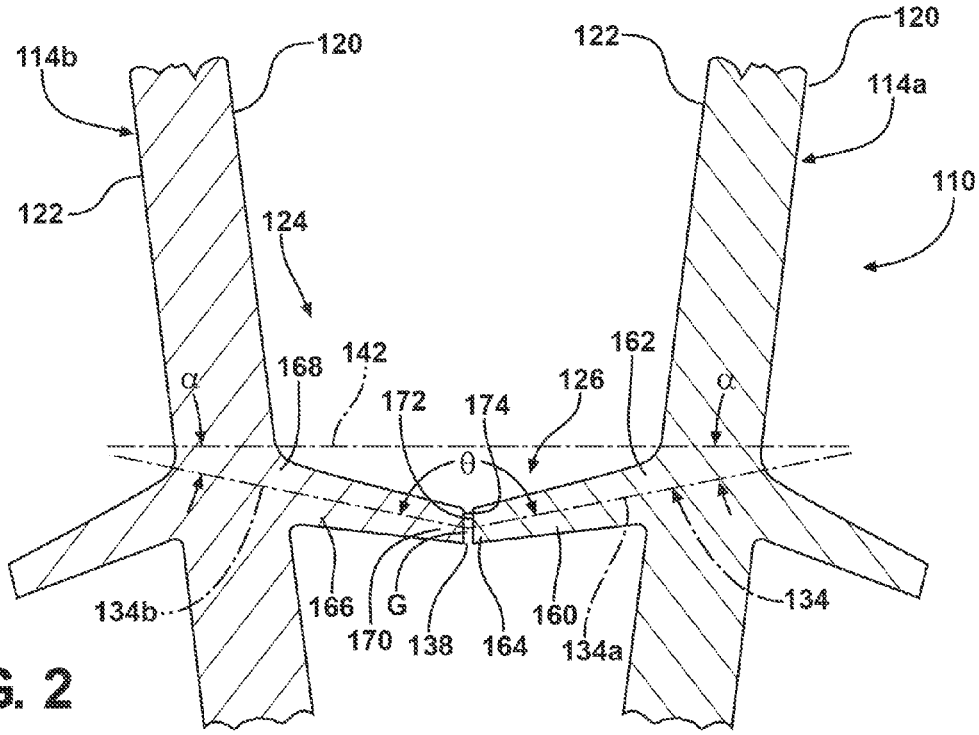
FIG. 2 is a partial end view of a pair of adjacent blades showing an alternative configuration of the embodiment of FIG. 1.

Referring to FIG. 2, an alternative configuration is illustrated comprising a variation of the embodiment shown in FIG. 1. Elements in FIG. 2 corresponding to elements in FIG. 1 are labeled with the same reference number increased by 100.

In FIG. 2, a rotor 110 including a damping structure 124 is illustrated. The damping structure 124 includes a snubber element 126 comprising an elongated first snubber element 160 extending from a first blade 114*a* toward an adjacent second blade 114*b*. The first snubber element 160 includes a first snubber end 162 rigidly attached to the first blade 114*a*, and an opposite second snubber end 164 extending to a midway point 138. An elongated second snubber element 166 extends from the second blade 114*b* toward the first blade 114*a* and includes a first snubber end 168 rigidly attached to the second blade 114*b*, and an opposite second snubber end 170 extending to the midway point 138.

The second snubber end 164 of the first snubber element 160 defines an engagement surface 172 located adjacent to a cooperating second engagement surface 174 on the second snubber end 170 of the second snubber element 166 at the midway point 138 between the first and second blades 114*a*, 114*b*. A snubber gap G is defined between the adjacent surfaces 172, 174 when the rotor 110 is stationary, i.e., with no centrifugal forces acting on the first and second snubber elements 160, 166. The first and second snubber elements 160, 166 define a centerline 134 wherein the centerline 134 comprises a first linear centerline segment 134*a* and a second linear centerline segment 134*b* extending along the first and second snubber elements 160, 166 respectively. The centerline segments 134*a*, 134*b* meet at an inflexion angle θ at the midway point 138 between the first and second blades 114*a*, 114*b*.

The configuration of FIG. 2 provides a damping structure 124 having a triangular configuration that includes the first and second snubber elements 160, 166 extending radially inwardly from a circumferential line 142 connecting radially outer edges of the first snubber end 162 of the first snubber element 160 and the first snubber end 168 of the second snubber element 166. In a preferred embodiment, the first and second centerline segments 134*a* and 134*b* each angle inwardly from the circumferential line 142 at an angle α. The angle α may be in the range of from about 3° to about 20°, and preferably is about 6°, such that the inflexion angle θ is about 178° when the rotor 110 is stationary. The damping structure 124 operates in the manner described above for the damping structure 24 of FIG. 1 wherein rotational movement of the rotor 110 produces a centrifugal force on the first and second snubber elements 160, 166 to move the snubber elements 160, 166 radially outwardly. As the snubber elements 160, 166 move outwardly, they pivot toward each other and close the snubber gap G. As the snubber gap G is closed, the first engagement surface 172 is positioned in frictional engagement with the second engagement surface 174 with a predetermined damping force determined by the centrifugal force loading the first and second snubber elements 160, 166. It is believed that the damping structure 124, including the first and second snubber elements 160, 166 positioned at the described angle of 6°, may produce a force at the snubber gap G of approximately 500 N, above any forces that may occur as a result of movements of the blades 114*a*, 114*b*, such as may result from blade untwist.

In the embodiments of the invention described with reference to FIGS. 1 and 2, in order to minimize or reduce the inertial loads on the first and second snubber elements 60, 66 (160, 166), these elements may be tapered extending from the respective first and second blades 14*a*, 14*b* (114*a*, 114*b*) toward the snubber gap G at the midway point 38 (138). That is, the radial thickness may progressively decrease from the snubber ends 62, 68 (162, 168) toward the midway point 38 (138). In addition, the taper may reduce aerodynamic resistance by providing the snubber elements 60, 66 (160, 166) with a reduced cross-sectional area to flow through the turbine between the blades.

Figure 3:
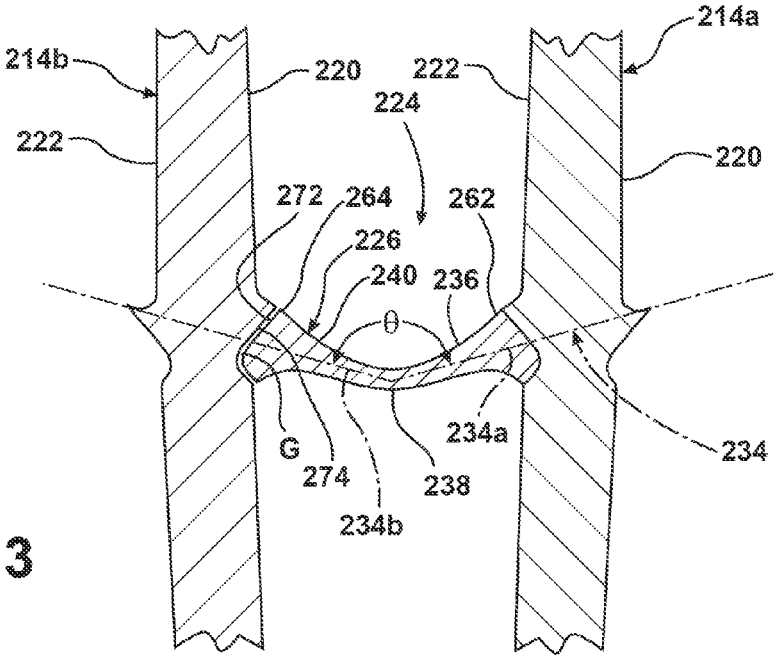
FIG. 3 is a partial end view of a pair of adjacent blades showing an alternative embodiment of the invention.

Referring to FIG. 3, an alternative embodiment of the invention is illustrated. Elements in FIG. 3 corresponding to elements in FIG. 1 are labeled with the same reference number increased by 200.

In FIG. 3, a damping structure 224 is provided comprising a elongated snubber element 226. The snubber element 226 includes a first snubber end 262 rigidly affixed to a first blade 214*a* and a second snubber end 264 defining a first engagement surface 272. The first snubber end 262 may be formed integrally with the first blade 214*a*, or may be a separate member that is bonded to the first blade 214*a* by any known means such as by welding, brazing, etc.

The first engagement surface 272 of the snubber element 226 is located adjacent to a cooperating or second engagement surface 274 on a second blade 214*b*. The snubber element 226 is formed with first and second generally linear portions 236, 240 wherein the centerline 234 of the snubber element 226 comprises a first linear centerline segment 234*a* and a second linear centerline segment 234*b*.

The centerline segments 234*a*, 234*b* meet at an inflexion angle θ at a midway point 238 between the first and second blades 214*a*, 214*b*. The first centerline segment 236 angles radially inwardly from the first snubber end 228 to the midway point 238, and the second centerline segment 240 angles radially outwardly from the midway point 238 to the second snubber end 230.

A gap G may be defined between the first and second engagement surfaces 272, 274. When the blades 214*a*, 214*b* rotate, centrifugal force acting on the snubber element 226 effects a movement of the second end 264 of the snubber element 226 radially outwardly, closing the gap G and causing the first engagement surface 272 to frictionally engage the second engagement surface 274 with a predetermined damping force. The second engagement surface 274 is preferably angled circumferentially toward the first blade 214*a*, in a radial outward direction, to cooperate with a similarly angled portion of the first engagement surface 272. The second engagement surface 274 preferably defines a pocket or socket for receiving the first engagement surface 272 in order to retain the first engagement surface 272 in contact with the second contact surface 274 during application of centrifugal and/or bending forces on the blades 214*a*, 214*b* and the snubber element 226.

It may be noted that the midway point 238 need not be located at a central or middle location between the blades 214*a*, 214*b*, but may be offset toward one side or the other, as long as the snubber element 226 can flex or bend under centrifugal force loads. Such an offset of the midway point 238 may be used to adjust the damping forces applied at the gap G.

In an alternative configuration, the snubber element 226 may be formed in the shape of an inwardly extending smooth curve, such as a curve as described with reference to FIG. 1. Further, the snubber element 226 may be formed with a reduced or tapering cross-section, extending from the ends 262, 264 to the midway point 238 to provide reduced weight and minimized aerodynamic drag losses.

In each of the above-described embodiments, it should be noted that structure is provided for controlling the damping force at a snubber gap between a snubber element and a cooperating surface using a radially inwardly extending configuration to produce a predetermined outwardly directed centrifugal force and a corresponding circumferentially directed damping force at the engaging surfaces.

The present invention is particularly applicable to large diameter, cooled turbine blades designed for high temperature (i.e., 850° C.) applications, such as may be used in industrial gas turbines. The present invention enables application of a controlled damping force through a mid-span snubber structure such as may be required for vibration damping of large diameter blades subjected to increased aerodynamic vibrations wherein the damping structure may provide a greater or lesser force, as required, at the snubber gap by utilizing a predetermined centrifugal force acting on the inwardly angled snubber element or elements. Further, it may be noted that the damping force provided by the snubber structures disclosed herein may be implemented with blades that have small camber or a low twist, since the damping force is not dependent on untwist of the blades.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A damping structure in a turbomachine rotor having a rotor disk and a plurality of blades, the damping structure comprising:

an elongated snubber structure including a first snubber end rigidly attached to a first blade and extending toward an adjacent second blade, and an opposite second snubber end defining a first engagement surface positioned adjacent to a second engagement surface associated with the second blade;

the snubber structure having a centerline extending radially inwardly in a direction from the first blade toward the second blade along at least a portion of the snubber structure between the first and second snubber ends;

including a midway point between the first and second blades, and a radial thickness of the snubber structure decreases progressively extending from each of the blades to the midway point; and wherein rotational movement of the rotor effects relative movement between the second snubber end and the second engagement surface to position the first engagement surface of the second snubber end in frictional engagement with the second engagement surface with a predetermined damping force determined by a centrifugal force on the snubber structure.

2. The damping structure according to claim 1, wherein the damping structure is located at a mid-span location between a blade root and a blade tip of the blade.

3. The damping structure according to claim 1, wherein the second engagement surface is at least partly formed on a side surface of the second blade.

4. The damping structure according to claim 3, wherein the centerline of the snubber structure comprises a substantially smooth curve with a concave side facing radially outwardly extending from the first snubber end to the second snubber end.

5. The damping structure according to claim 3, wherein the centerline of the snubber structure comprises first and second linear centerline segments and an inflexion angle between the centerline segments at the midway point between the first and second blades, the first centerline segment angling radially inwardly from the first snubber end to the midway point and the second centerline segment angling radially outwardly from the midway point to the second snubber end.

6. The damping structure according to claim 1, wherein the snubber structure comprises a first snubber element, the snubber structure further comprising a second snubber element having a first snubber end rigidly attached to the second blade and a second snubber end located adjacent to the second end of the first snubber element, the second snubber end of the second snubber element defining the second engagement surface.

7. The damping structure according to claim 6, wherein a snubber gap is defined between the first and second snubber elements when the rotor is stationary, the first and second snubber elements define respective first and second centerline segments that angle radially inwardly from the first snubber ends toward the snubber gap, and the second ends of the first and second snubber elements move radially outwardly to engage each other with a predetermined force during rotation of the rotor.

8. The damping structure according to claim 6, wherein the centerline is defined by the first and second snubber elements and comprises a substantially smooth curve with a concave side facing radially outwardly extending from the first snubber end of the first snubber element to the first snubber end of the second snubber element.

9. The damping structure according to claim 6, wherein the centerline of the snubber structure comprises first and second linear centerline segments and an inflexion angle between the centerline segments at a midway point between the first and second blades, the first centerline segment angling radially inwardly from the first snubber end of the first snubber element to the midway point and the second centerline segment angling radially inwardly from the first snubber end of the second snubber element to the midway point.

10. A mid-span damping structure in a turbomachine rotor having a rotor disk and a plurality of blades, the mid-span damping structure comprising:

an elongated first snubber element including a first snubber end rigidly attached to a first blade, and an opposite second snubber end, the first snubber element extending toward an adjacent second blade;

an elongated second snubber element including a first snubber end rigidly attached to the second blade, and an opposite second snubber end, the second snubber element extending toward the first blade;

the second end of the first snubber element being located adjacent to the second end of the second snubber element at a midway point between the first and second blades;

a radial thickness of both the first and the second snubber elements decreases progressively extending from a location adjacent to the first and second blades, respectively, to the midway point;

the first and second snubber elements defining a centerline extending radially inwardly in a direction from the first blade toward the midway point and extending radially inwardly in a direction from the second blade toward the midway point; and wherein rotational movement of the rotor effects relative movement between the second snubber ends of the first and second snubber elements to position the second snubber ends in frictional engagement with each other with a predetermined damping force determined by a centrifugal force on the first and second snubber elements.

11. The damping structure according to claim 10, wherein a snubber gap is defined between the first and second snubber elements when the rotor is stationary, and the second ends of the first and second snubber elements move radially outwardly to engage each other with a predetermined force during rotation of the rotor.

12. The damping structure according to claim 10, wherein the centerline defined by the first and second snubber elements comprises a substantially smooth curve with a concave side facing radially outwardly extending from the first snubber end of the first snubber element to the first snubber end of the second snubber element.

13. The damping structure according to claim 10, wherein the centerline defined by the first and second snubber elements comprises first and second linear centerline segments and an inflexion angle between the centerline segments at the midway point between the first and second blades, the first centerline segment angling radially inwardly from the first snubber end of the first snubber element to the midway point and the second centerline segment angling radially inwardly from the first snubber end of the second snubber element to the midway point.

14. The damping structure according to claim 13, wherein the first and second centerline segments each extend radially inwardly from a circumferential line extending between the first snubber ends of the first and second snubber elements at an angle of about 6° to define an inflexion angle of about 178°.

15. A damping structure in a turbomachine rotor having a rotor disk and a plurality of blades, the damping structure comprising:

an elongated first snubber element including a first snubber end rigidly attached to a first blade, and an opposite second snubber end, the first snubber element extending toward an adjacent second blade;

an elongated second snubber element including a first snubber end rigidly attached to the second blade, and an opposite second snubber end, the second snubber element extending toward the first blade;

the second end of the first snubber element being located adjacent to the second end of the second snubber element at a midway point between the first and second blades;

the first and second snubber elements defining a centerline extending radially inwardly in a direction from the first blade toward the midway point and extending radially inwardly in a direction from the second blade toward the midway point, and the centerline defined by the first and second snubber elements comprises a substantially smooth curve with a concave side facing radially outwardly extending from the first snubber end of the first snubber element to the first snubber end of the second snubber element;

wherein a radial thickness of both the first and the second snubber elements decreases progressively extending from a location adjacent to the first and second blades, respectively, to the midway point; and wherein a snubber gap is defined between the first and second snubber elements when the rotor is stationary, and rotational movement of the rotor effects radial outward movement of the second snubber ends of the first and second snubber elements to position the second snubber ends in frictional engagement with each other with a predetermined damping force determined by a centrifugal force on the first and second snubber elements.

16. The damping structure according to claim 15, wherein the damping structure is located at a mid-span location between a blade root and a blade tip of the blade.

* * * * *